US006550293B1

(12) United States Patent
Delegato et al.

(10) Patent No.: US 6,550,293 B1
(45) Date of Patent: Apr. 22, 2003

(54) GARMENT LOCK

(76) Inventors: David A. Delegato, 13690 Lancaster, Shelby Township, MI (US) 48315; Regina D. Delegato, 13690 Lancaster, Shelby Township, MI (US) 48315

( * ) Notice: Subject to any disclaimer, the term of this patent is extended or adjusted under 35 U.S.C. 154(b) by 0 days.

(21) Appl. No.: 10/164,921

(22) Filed: Jun. 6, 2002

(51) Int. Cl.[7] ..... E05B 69/00; E05B 73/02

(52) U.S. Cl. ..... 70/59; 70/60; 70/49; 70/18; 24/3.13; 24/909; 211/4

(58) Field of Search ..... 70/59, 60, 30, 70/49, 57.1, 14, 18, 19, 233; 211/4–9; 24/3.13, 269, 909

(56) References Cited

U.S. PATENT DOCUMENTS 3,647,072 A * 3/1972 Strang ..... 211/4
3,906,758 A * 9/1975 Hurwitt ..... 70/30
4,037,441 A * 7/1977 Ray ..... 70/233
4,069,919 A * 1/1978 Fernbaugh ..... 211/4
4,073,415 A * 2/1978 Pegg ..... 223/92
4,260,063 A * 4/1981 Bennett et al. ..... 211/4
4,460,092 A * 7/1984 Lee ..... 211/4
4,460,093 A * 7/1984 Otema ..... 211/4
4,543,806 A * 10/1985 Papandrea et al. ..... 70/30
4,685,572 A * 8/1987 Jamison ..... 211/4
D296,659 S * 7/1988 Sakai ..... D8/331
4,896,517 A * 1/1990 Ling ..... 70/18
4,956,982 A * 9/1990 Valley ..... 70/59
4,986,457 A * 1/1991 Faris ..... 223/1
5,785,184 A * 7/1998 Metselaar ..... 211/4
5,786,759 A * 7/1998 Ling ..... 340/542
5,960,652 A * 10/1999 Marmstad ..... 70/49

* cited by examiner

*Primary Examiner*—Anthony Knight
*Assistant Examiner*—John B. Walsh

(57) ABSTRACT

A garment lock has a casing, a spool, two springs, and a member, flexible long and thin. The casing has a first side with a post and a second side with tabs, both joined by a rim. The casing attaches to a garment with a pin. The spool rotates upon the post within the casing. The springs resist rotation and movement of the spool. The member as wire, chain, or tape, winds upon the spool. Upon reaching the desired length of the member, the casing removably locks the spool. After use, the flexible thin member retracts into the casing.

15 Claims, 3 Drawing Sheets

GARMENT LOCK

BACKGROUND OF THE INVENTION

1. Field of the Invention

The present invention relates to a garment lock for use in connection with securing portable property against theft. The garment lock has particular utility in securing garments with a retractable wire.

2. Description of the Prior Art

Garment locks are desirable to secure garments to a solid object in the absence of the garment's wearer. Garments like coats and jackets increase in cost each year. At the same time, the risk of theft increases when the wearer has removed the garment and temporarily left it unattended in a public place. Lockers and coatrooms to secure valuable garments may inconvenience the wearer. Some restaurants and clubs have unattended coatrooms. Further, some restaurants, entertainment venues, and other places suitable for expensive garments lack a coatroom. This situation has made some people reluctant to wear their best garments in the event a wearer leaves a garment unattended. Even while wearing the garments, worries about security hamper the enjoyment of the wearer.

The use of other locks for garments is known in the prior art. For example, U.S. Pat. No. 4,956,982 to Valley discloses an anti-theft device for garments. However, the Valley '982 patent does not retract the chain into a compact case, and has further drawbacks of the device not attaching to a garment and no connection of the padlock to the chain.

U.S. Pat. No. 4,502,305 to Bakker discloses a security latch that has a flexible shackle that locks into the body of the padlock. However, the Bakker '305 patent does not retract the shackle, and additionally does not attach to a garment.

Similarly, U.S. Pat. No. 4,037,441 to Ray discloses a bicycle lock that has a retractable cable. However, the Ray '441 patent does not removably secure the housing with tabs, and the bar clamp cannot readily detach from a bicycle frame.

Similarly, U.S. Pat. No. 4,896,517 to Ling discloses a wire lock that self retracts wire. However, the Ling '517 patent does not secure the reel with interlocking tabs and holes, does not release the wire with a button on the center of the reel, and cannot secure the wire to the outside of the casing.

Lastly, U.S. Pat. No. Des. 296,659 to Sakai discloses a combination lock that has a coiled cable. However, the Sakai Des. '659 patent does not secure the cable to the outside of the case, and has the additional deficiency of requiring a wearer to remember a combination.

While the above-described devices fulfill their respective, particular objectives and requirements, the aforementioned patents do not describe a garment lock that allows securing garments with a retractable wire. The Valley '982 and the Bakker '305 patents make no provision for retracting the chain. The Ray '441 does not removably secure the housing. The Ling '517 patent does not secure the wire to the outside of the casing. The Sakai Des. '659 patent lacks an exterior connection of the cable to the case. Therefore, a need exists for a new and improved garment lock that can be used for securing garments with a retractable wire. In this regard, the present invention substantially fulfills this need. In this respect, the garment lock according to the present invention substantially departs from the conventional concepts and designs of the prior art, and in doing so provides an apparatus primarily developed for the purpose of securing garments with a retractable wire.

SUMMARY OF THE INVENTION

In view of the foregoing disadvantages inherent in the known types of locks for garments now present in the prior art, the present invention provides an improved garment lock, and overcomes the above-mentioned disadvantages and drawbacks of the prior art. As such, the general purpose of the present invention, which will be described subsequently in greater detail, is to provide a new and improved garment lock and method which has all the advantages of the prior art mentioned heretofore and many novel features that result in a garment lock which is not anticipated, rendered obvious, suggested, or even implied by the prior art, either alone or in any combination thereof.

To attain this, the present invention essentially comprises a garment lock with a casing, a post, a spool, a first spring, a second spring, a member flexible long and thin, a means to secure the member, and a means to lock the spool. The casing has a first side with a post, a second side with tabs, and a rim that joins both sides and has an exit for the member. On the outside of the first side, the casing has a means to attach the casing to a garment. Inside the casing, a post has a base centered on the insider of the first side of the casing and a free end extending into the casing. The free end does not reach the second side of the casing. The spool has a button in the center to move the spool along the post. The spool mounts upon the post and rotates within the casing. The first spring connects to the post and the spool, resisting the rotation of the spool. The second spring rests between the spool and the first side of the casing. The second spring resists the movement of the spool towards the base of the post when a person presses the button. The member has a first end with a linking means and a second end fixed to the spool. The member winds upon the spool in many turns, and then passes through the exit in the rim. The first end of the member removably links to a ring fixed to the rim of the casing opposite the exit. Upon reaching the desired length of the member, the casing removably locks the spool with tabs from the second side projecting into the casing and the spool. A wearer secures the member to furniture such as chairs or fixtures such as a closet bar. After use, the member retracts into the casing so that the garment lock fits into a pocket of a garment.

There has thus been outlined, rather broadly, the more important features of the invention in order that the detailed description thereof that follows may be better understood and in order that the present contribution to the art may be better appreciated.

The invention may also include a casing that attaches to a garment with a pin, a hook and loop fastener, or a magnet; a member that is a wire, a chain, or metal tape, coated or uncoated; a first end of the member that is a shackle or a clip; and the rim may also have an attached tab, wire, or loop to secure the first end of the member. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and the scope of the present invention.

It is therefore an object of the present invention to provide a new and improved garment lock that has all of the advantages of the prior art locks for garments and none of the disadvantages.

It is another object of the present invention to provide a new and improved garment lock that may be easily and efficiently manufactured and marketed.

An even further object of the present invention is to provide a new and improved garment lock that has a low cost of manufacture with regard to both materials and labor, and which accordingly is then susceptible of low prices of sale to the consuming public, thereby making such garment lock economically available to the buying public.

Still another object of the present invention is to provide a new garment lock that provides in the apparatuses and methods of the prior art some of the advantages thereof, while simultaneously overcoming some of the disadvantages normally associated therewith.

Even still another object of the present invention is to provide a garment lock for securing garments with a retractable wire. This allows compact storage and ready transport of the present invention.

Still yet another object of the present invention is to provide a garment lock for securing garments with a retractable wire. This makes it possible to secure garments to a variety of furniture and fixtures.

Still yet another object of the present invention is to provide a garment lock for securing garments with a retractable wire. This makes it possible to attach the casing removably to a garment.

Lastly, it is an object of the present invention to provide a new and improved method for deterring theft of garments by the following steps: extending a wire from within a casing; threading the wire through the first sleeve of a garment; securing the casing to the inside of the garment; passing the wire around a solid object; threading the wire through a second sleeve of the garment; then securing the wire to the casing.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
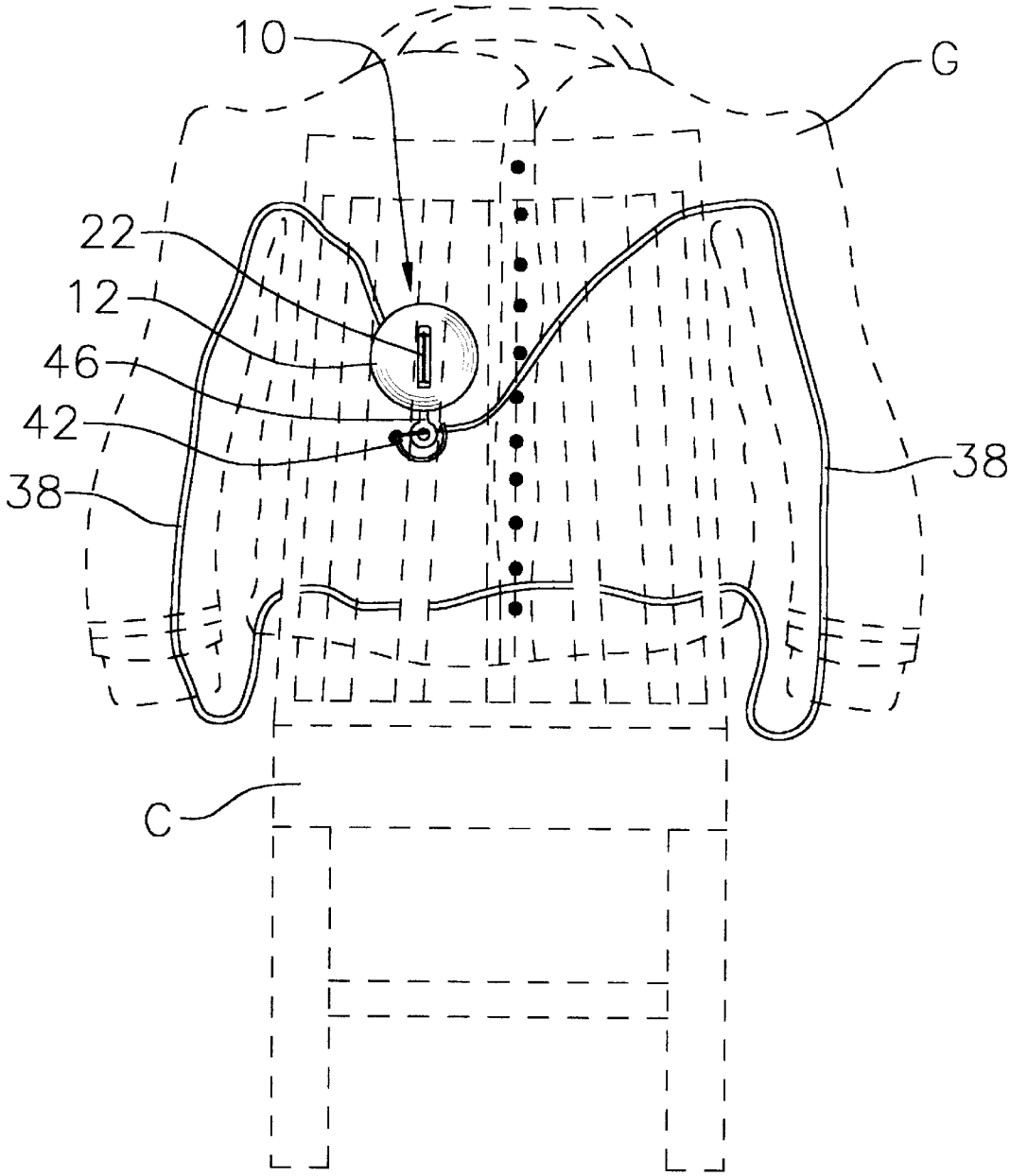
FIG. 1 is a elevation view of the preferred embodiment of the garment lock in use upon a chair and constructed in accordance with the principles of the present invention.

Referring now to the drawings, and particularly to FIGS. 1–5, a preferred embodiment of the garment lock of the present invention is shown and generally designated by the reference numeral In FIG. 1, a new and improved garment lock 10 of the present invention for securing garments with a retractable wire is illustrated and will be described. More particularly, the garment lock 10 has a casing 12 attached to the inside of a garment G. A member 38 extends from the casing 12 through a sleeve of the garment G, the rungs of the back of a chair C, and then the other sleeve of the garment G. The member 38 returns to the casing 12 and terminates in a linking means 42 that connects with the means 46 to secure the first end 40 of the member 38. In the preferred embodiment, the member 38 is a metal wire.

Figure 2:
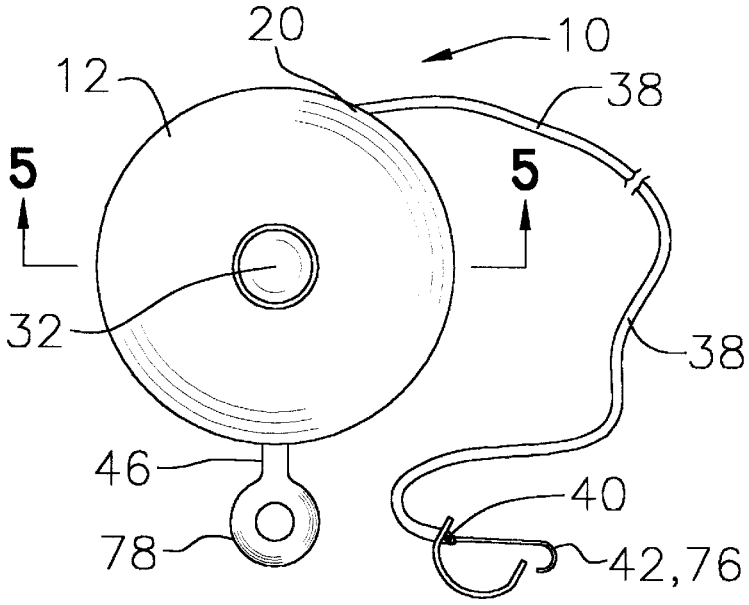
FIG. 2 is a plan view of the garment lock of the present invention.

Turning to FIG. 2, the casing 12 of round metal has a first side 14 and a second side 16 joined by a rim 18. The second side 16 appears in FIG. 2 with a button 32 centered in the second side 16. The member 38 extends from the rim 18 at the exit 20 and has a first end 40 shown. The first end 40 terminates in a linking means 42. Opposite from where the member 38 extends from the rim 18, a means 46 to secure the first end 40 of the member 38 attaches to the rim 18. In the preferred embodiment, the means 46 to secure the first end 40 of the member 38 is a round ring 78 with a stem that attaches to the rim 18 and the linking means 42 is a shackle 76 with a pivoting section that closes upon a fixed section so that the linking means 42 grasps the ring 78.

Figure 3:
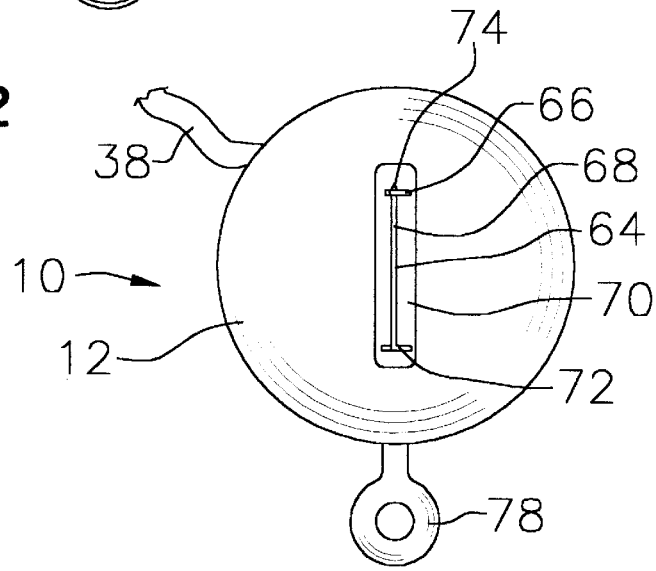
FIG. 3 is a reverse plan view of the garment lock of the present invention.

In FIG. 3, the first side 14 of the casing 12 appears with a centered means 22 to attach the casing 12 to a garment G. In the preferred embodiment, the means 22 to attach the casing 12 is a pin 64 with a loop 66, a shaft 68, and a plate 70. The shaft 68 has a fixed end 72 and an opposite pointed end 74. The fixed end 72 binds the pin 64 to the plate 70. The pointed end 74 passes the shaft 68 through garments G and engages the loop 66. The loop 66 attaches to the plate 70 opposite from the fixed end 72. The plate 70 attaches to the first side 14 of the casing 12 substantially along a line between the ring 78 and the exit 20.

Figure 4:
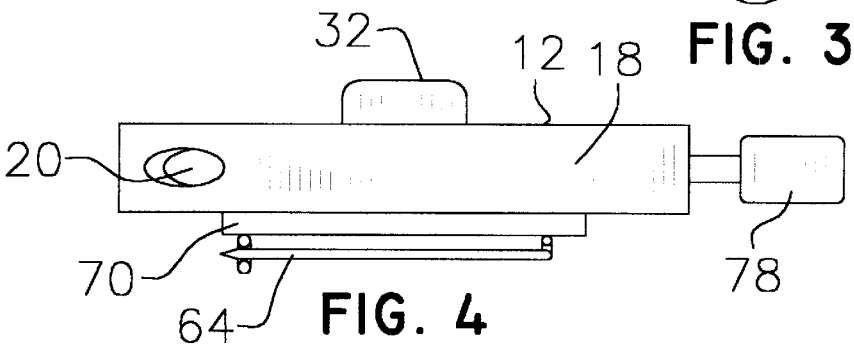
FIG. 4 is a side view of the garment lock of the present invention.

Moving to FIG. 4, the side view of the casing 12 appears. The button 32 extends outward from the second side 16 of the casing 12 and the pin 64 attaches to the first side 14 of the casing 12. The rim 18 between the first side 14 and the second side 16 has an exit 20 to pass the member 38. Opposite the exit 20, the ring 78 extends outward from the rim 18.

Figure 5:
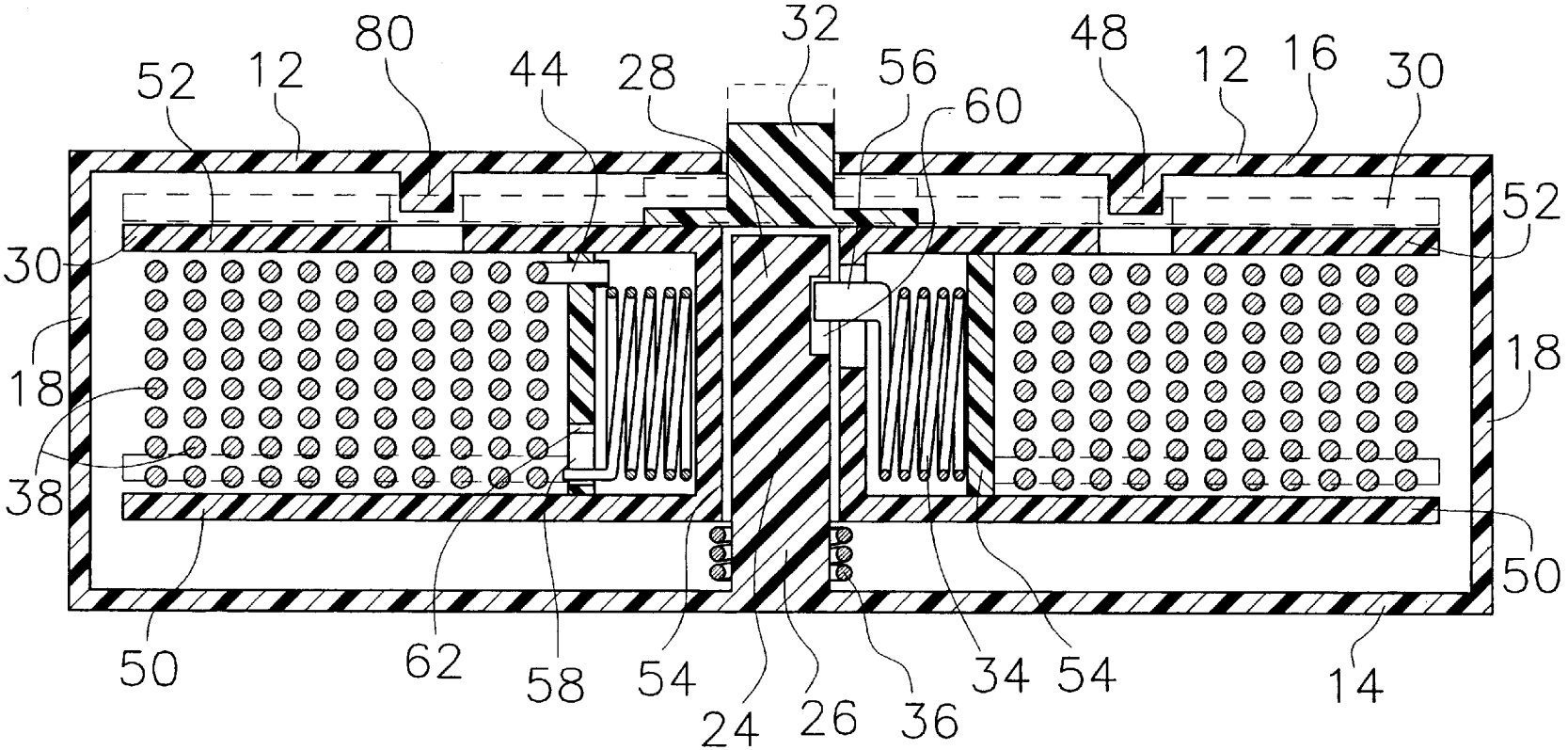
FIG. 5 is a section view of the casing and spool of the garment lock of the present invention.

Turning to FIG. 5, the casing 12 contains the spool 30 with the first side 14, the second side 16, and the means 48 to secure the spool 30. In the lower half of FIG. 5, the first side 14 of the casing 12 has a post 24 of round cross section with a base 26 fixed to and centered within the first side 14 and a free end 28 opposite from the base 26. The post 24 extends into the casing 12 for substantially the distance between the first side 14 and the second side 16 of the casing 12 but does not reach the second side 16 of the casing 12. Near the free end 28, the post 24 has a slot. In the upper half of FIG. 5, the second side 16 of the casing 12 has a centered hole that admits the button 32 and numerous tabs 80 extending into the casing 12. The second side 16 has the tabs 80 arrayed in a regular pattern as the means 48 to secure the spool.

Moving to the spool 30, the spool 30 has a first flange 50, a second flange 52, and a hub 54 centered between and joining the flanges. The first flange 50 is near the base 26 of the post 24 and the first side 14 of the casing 12 and has a centered hole to admit the post 24. The second flange 52 is near to the second side 16 of the casing 12 and has a centered hole to admit the post 24 and a regular pattern of holes to match the tabs of the second side 16. Further, the second flange 52 has a centered button 32 attached above the hub 54. The hub 54 rotates about the post 24 within the casing 12. The second end 44 of the member 38 is secured to the hub 54.

Between the post 24 and the hub 54, the first spring 34 resists rotation of the spool 30 as a wearer extends the member 38. The first spring 34 is a concentrically coiled torsion spring with a first tab 56 and a second tab 58. The first tab 56 engages the slot in the post 24 and the second tab 58 engages a slot in the hub 54. As the member 38 extends from the spool 30, the first spring 34 lengthens. The second spring 36 resists movement of the spool 30 towards the base 26 of the post 24 and the first side 14. The second spring 36 is a compression spring mounted over the post 24 that floats between the hub 54 and the first side 14 of the casing 12. Once the wearer extends the member 38 sufficiently, the hub 54 stops rotating and the second spring 36 pushes the hub 54 and spool 30 towards the tabs of the second side 16. To retract the member 38, the wearer presses the button 32 and releases the second flange 52 from the tabs 80. The first spring 34 then engages the hub 54 to rotate the spool 30 and to wind the member 38 upon the spool 30. FIG. 5. further shows the spool 30 in overlapping views. The solid lines have the spool 30 disengaged from the tabs 80 and free to rotate. The dotted lines have the spool 30 engaged by the tabs 80 and prevented from rotating.

In use, it can now be understood that a wearer can readily use the garment lock 10 to secure a garment G in various locations. To employ the garment lock 10, a wearer holds the garment lock 10 and presses the button 32. The wearer extends the member 38 a sufficient length to pass through both sleeves of a garment G. The wearer then inserts the member 38 through one sleeve, around a solid object, and then through a second sleeve. Bringing the linking means 42 to the ring 78, the wearer secures the linking means 42 to the ring 78 and the casing 12 to the garment G with the pin 64. To remove the garment lock 10, the wearer releases the linking means 42 then retrieves the member 38 from the sleeves and releases the member 38 from the solid object. To retract the member 38, the wearer presses the button 32 to release the second flange 52 of the spool 30 from the tabs 80 and rewind the member 38 upon the spool 30.

While a preferred embodiment of the garment lock has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, metal alloy, or a variety of wood may be used instead of the metal casing described. Also, the member may also be tape, cable, chain, or similar material. And although securing garments with a retractable wire has been described, it should be appreciated that the garment lock herein described is also suitable for securing luggage and other movable property. Furthermore, a wide variety of coated wires may be used instead of the wire described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A garment lock comprising:

a casing having a first side, a second side, a rim joining said first side and said second side, an exit within said rim, and a means to attach said casing to a garment;

a post, with a base, centered within said first side of said casing and a free end, that projects into said casing but short of said second side of said casing;

a spool with a centered button, mounted upon said post for rotation within said casing;

a first spring connected to said post and said spool for resiliently opposing rotation of said spool in one direction about said post;

a second spring between said spool and said first side of said casing for resiliently opposing movement of said spool towards the base of said post;

a member, flexible long and thin, having a first end with a linking means and a second end fixed to said spool, wound upon said spool in a plurality of turns, and said member passes through said exit in said rim;

a means to secure said first end of said member, said means fixed to said rim of said casing;

a means that removably secures said spool, depending into said casing from said second side of said casing;

and said member being retractable into said casing so that said garment lock fits into a pocket of a garment.

2. The garment lock of claim 1 further comprising:

said casing of round shape where the diameter of said casing substantially exceeds the height of said rim, said first side has a round shape with said post centered upon said first side, said second side has a round shape with a centered hole to admit said button, said rim joins the perimeter of said first side and said second side, and said rim has said exit to allow passage of said flexible long thin member;

said post of a round cross section, having said base fixed to and centered within said first side of said casing, extending into said casing substantially the distance between said first side and said second side but not reaching said second side of said casing;

and said spool of round shape having a first flange, a second flange, and a hub centered between and joining said first flange and said second flange, said first flange is proximate to said first side of said casing and has a centered hole to admit said post, said second flange is proximate to said second side of said casing, has a centered hole to admit said post and a centered button attached above said centered hole, said hub rotates about said post within said casing.

3. The garment lock of claim 1 wherein, said first spring is a concentrically coiled torsion spring with a first tab and a second tab, said first tab engages a slot in said post and said second tab engages a slot in said hub of said spool so that said torsion spring resiliently opposes rotation of said spool in one direction, and said second spring is a compression spring, mounted over said post and floating between said hub of said spool and said first side of said casing so that said compression spring resiliently opposes movement of said spool towards said first side of said casing.

4. The garment lock of claim 1 wherein said means to attach said casing is a pin having a loop, a shaft, and a base, said base attaches to the outside of said first side of said casing, said shaft has a fixed end fixed to said base and a pointed end opposite said fixed end, said pointed end removably engages said loop to close said pin, and said loop is fixed to said base.

5. The garment lock of claim 1 wherein said linking means is a shackle attached to said first end of said member.

6. The garment lock of claim 1 wherein said linking means is a clip, said clip has an arcuate major jaw fixed to said first end of said member and a spring loaded cooperating minor jaw that closes said major jaw.

7. The garment lock of claim 1 wherein said member is a wire.

8. The garment lock of claim 1 wherein said member is a metal tape.

9. The garment lock of claim 1 wherein said means to secure said first end is a ring extending out from said rim, and opposite said exit.

10. The garment lock of claim 1 wherein said means to secure said first end is a tab with a centered hole attached to said rim, extending out from said rim, and opposite said exit.

11. The garment lock of claim 1 wherein said means to secure said first end is a wire bent into an arch secured to said rim, extending out from said rim, and opposite said exit.

12. The garment lock of claim 1 wherein said means to secure said spool is a plurality of tabs arranged in a regular pattern depending from said second side towards the interior of said casing that removably engage holes with in said second flange of said spool to lock said spool in position whereby depressing said button disengages said second flange of said spool from said tabs to allow rotation of said spool.

13. A method for deterring theft of garments, the steps comprising:

extending a member, flexible long and thin, from within a casing;

threading said member through a first sleeve of said garment;

securing said casing to the inside of said garment;

passing said member around a solid object;

threading said member through a second sleeve of said garment;

then securing said flexible member to said casing.

14. The method for deterring theft of garments of claim 13 wherein said member is passed around a rung of a back of a chair.

15. The method for deterring theft of garments of claim 13 wherein said member is passed around a bar for hanging said garments.

* * * * *